US007074014B2

(12) United States Patent
Ichinose

(10) Patent No.: US 7,074,014 B2
(45) Date of Patent: Jul. 11, 2006

(54) DIPPING TYPE PUMP WHERE DISCHARGING PERFORMANCE AT A TIME OF ACTUATION HAS BEEN IMPROVED

(75) Inventor: Takeo Ichinose, Tsukuba-gun (JP)

(73) Assignee: SMC Corporation, Tokyo (JP)

( * ) Notice: Subject to any disclaimer, the term of this patent is extended or adjusted under 35 U.S.C. 154(b) by 253 days.

(21) Appl. No.: 10/404,346

(22) Filed: Apr. 2, 2003

(65) Prior Publication Data

US 2003/0235506 A1 Dec. 25, 2003

(30) Foreign Application Priority Data

Jun. 25, 2002 (JP) ..... 2002-185140

(51) Int. Cl.
*F04B 17/03* (2006.01)

(52) U.S. Cl. ..... 417/306; 417/423.3; 137/202

(58) Field of Classification Search ..... 417/440, 417/423.3, 423.5, 297.5, 299, 306; 137/202
See application file for complete search history.

(56) References Cited

U.S. PATENT DOCUMENTS

| | | | | |
|---|---|---|---|---|
| 3,662,725 | A * | 5/1972 | Dragon et al. | 123/518 |
| 3,741,675 | A * | 6/1973 | Porter et al. | 415/11 |
| 3,867,071 | A * | 2/1975 | Hartley | 417/211.5 |
| 4,684,333 | A * | 8/1987 | Hirakawa et al. | 417/420 |
| 4,940,397 | A * | 7/1990 | Kuhlen | 417/435 |
| 5,042,519 | A * | 8/1991 | Kerlin | 137/43 |
| 6,171,080 | B1 * | 1/2001 | Watanabe et al. | 417/423.3 |

* cited by examiner

*Primary Examiner*—Charles G. Freay
(74) *Attorney, Agent, or Firm*—Oblon, Spivak, McClelland, Maier & Neustadt, P.C.

(57) ABSTRACT

In a dipping type pump where a rotary shaft extending from a motor into a pump casing disposed in liquid is mounted with impellers, and liquid is sucked from a sucking port at a lower portion of the casing and discharged from a discharge port by rotational driving of the motor, where a check valve for air purge which allows outflow of gas from the interior of the casing but prevents outflow of liquid therefrom is provided at an upper portion of the casing.

6 Claims, 3 Drawing Sheets

DIPPING TYPE PUMP WHERE DISCHARGING PERFORMANCE AT A TIME OF ACTUATION HAS BEEN IMPROVED

TECHNICAL FIELD

The present invention relates to a dipping type pump where a pump casing is dipped in liquid to transfer the liquid, and further particularly to a dipping type pump where a discharging performance at a time of actuation has been improved by providing a check valve for air purge in a pump casing.

PRIOR ART

In a semiconductor fabricating apparatus, as shown in FIG. 6, a dipping type multi-stage pump 31 (refer to FIG. 2 in JP11-241698A publication, for example) constituted so as to dip a casing 33 of a pump in circulated constant-temperature liquid in a tank 32 storing the same therein, suck liquid L in the tank 32 from a sucking port 34 opened in the liquid at a lower portion of the casing 33 to feed the sucked liquid to an external piping system 43 in a pressurizing manner is frequently used conventionally in a liquid circulating system for circulating constant-temperature liquid for temperature-controlling a semiconductor device or the like.

This dipping type multi-stage pump 31 is constituted such that a multi-stage impeller (a plurality of impellers) 35 mounted at a distal end side of the a rotary shaft 46 extending downward from a motor 45 positioned above a liquid surface is rotated inside the casing 33 by rotationally driving the motor 45 so that liquid is sucked up into the casing 33 from a sucking port 34 positioned at a lower portion of the casing 33 and pressurized and the liquid is discharged from a discharging port 38 to the external piping system 43. The discharged liquid is returned back to the tank 32 through an interior of the external piping system 43 by a circulating pipe (not shown). Further, in the external piping system 43 provided with such a dipping type pump, since such a case that circulating liquid in the interior of the external piping system 43 flows backward to the side of the tank 32 may occur at a time of stop of the pump according to use conditions, a check valve 42 is provided at a secondary side of the pump, as needed.

In the above-described dipping type multi-stage pump, since the rotary shaft 46 of the motor 45 penetrates the casing 33 necessarily, it is necessary to seal a penetrated portion 48 of the casing securely in view of a pump performance. However, in case that such sealing has been made, air stayed in the casing 33 at such a time when circulating liquid is temporarily discharged from the tank 32 and then recharged in the tank or gas stayed in the casing 33 for any reason can not be discharged from the casing so that the impeller 35 races at a time of actuation of the pump, which results in failure in pumping action.

In view of the above, such a structure is generally employed that fluid leaks through the penetrated portion 48 slightly, so that air, gas or the like staying in the casing 33 is caused to leak externally. A structure allowing leakage of fluid from the penetrated portion 48 or a structure where a small hole is provided at a portion of the casing 33 to discharge air or the like is effective considering that a circulating liquid is always filled in the casing 33 by discharging the air or the like in the casing 33 so that circulating liquid can rapidly be fed at a time of actuation of the pump.

However, since liquid leaks from the portion at a time of actuation of the pump, the pumping efficiency is not only lowered but also it is necessary to consider means for preventing leaked liquid from scattering. Further, in case that liquid with a high viscosity is used as the circulating liquid, there is also a problem that air cannot be discharged.

Therefore, in the known dipping type multi-stage pump shown in FIG. 6, such a constitution is employed that secure sealing is performed at the penetrated portion 48 so that air or the like staying the casing 33 is wound into the casing 33 by a screw 55 for circulating liquid winding provided at a distal end of the rotary shaft 46. However, since air exists in the casing 33 and liquid is wound into while compressing the air, a sufficient effect cannot be expected unless the winding is performed under excellent conditions.

In addition, in such a case that backward flow from the external piping system 43 is prevented by providing the check valve 42 at the secondary side of the pump, since back pressure acts on the check valve 42 due to liquid staying in the external piping system 43, it is necessary to secure a pump discharge (delivery) pressure to a certain extent from an initial stage of actuation of the pump. Therefore, it is absolutely difficult to actuate the pump with such a pressure as obtained by liquid winding of the above-described screw 55, and much time is required even if the pump can be actuated.

DISCLOSURE OF THE INVENTION

The present invention has solved the above-described problem of the conventional dipping type pump and a technical object thereof is to allow automatic discharge of air or the like staying in the casing by simple means in the above-described dipping type pump while suppressing outflow of liquid from the casing to improve a pump efficiency, thereby improving not only the pump efficiency of the dipping type pump but also a discharge performance at a time of actuation of the pump.

In order to solve the above problem, according to the present invention, there is provided a dipping type pump where a discharging performance at a time of actuation has been improved, which is constituted such that a rotary shaft is provided inside a pump casing whose portion is dipped in liquid, a plurality of impellers are mounted to the rotary shaft, and liquid is sucked from a sucking port at a lower portion of the pump casing and discharged from a discharging port by rotating and driving the rotary shaft by a motor, where in a check valve for allowing outflow of gas from the casing but preventing outflow of liquid from the casing is provided at an upper position of the pump casing.

The dipping type pump having the above-described constitution is used in a state that the pump casing is partially dipped in liquid in a tank but air, gas or the like is automatically discharged through the check valve provided in the casing, so that the interior of the casing is always put in a state that liquid has been filled up to a liquid level in the tank. Therefore, actuation of the pump is made considerably smoothly so that an excellent discharge performance at a time of actuation can be achieved. On the other hand, since the check valve allows outflow of gas in the casing but prevents outflow of liquid, liquid is prevented from flowing out from the casing at an ordinary time of pump operation so that a pump efficiency can be improved.

Further, according to the above-described dipping type pump, improvement of a pump efficiency and a discharge performance at a time of actuation can be realized by simple and inexpensive means such as providing a check valve with a simple structure in the casing.

According to a preferred specific embodiment of the invention, the above-described check valve comprises a valve chamber provided with a relief valve seat communicating with a relief port, and one spherical valve body movably accommodated in the valve chamber, and the valve body is constituted such that valve body is not pushed and moved toward a position closing the relief valve seat by gas flowing from the casing into the valve chamber but is pushed and moved toward the position closing the relief valve seat by liquid flowing into the valve chamber.

In this case, it is preferable that the relief valve seat is made of such a hard material as metal or ceramic and is provided at a position of an upper end portion of the valve chamber, and the valve body is made of hard material having a specific gravity larger than that of the liquid and is accommodated in the valve chamber movably in a vertical direction.

Other structure of the invention will be apparent from the following explanation.

DETAILED DESCRIPTION

Figure 1:
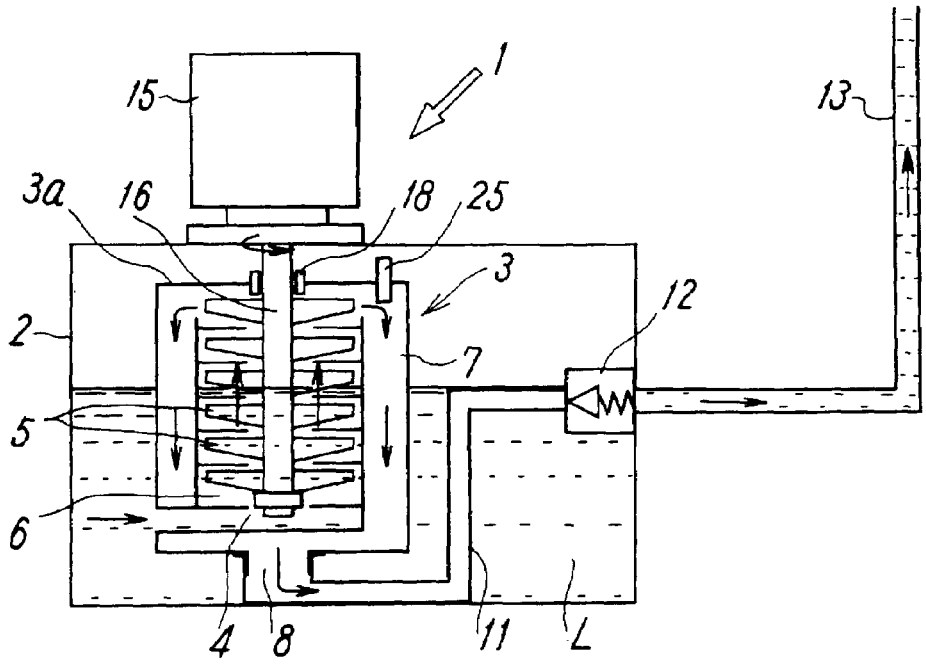
FIG. 1 is a vertical sectional view showing a usage state of an embodiment of a dipping type pump according to the present invention.

FIG. 1 shows an embodiment of a dipping type pump where a discharge performance at a time of actuation thereof has been improved according to the present invention. The dipping type pump 1 is suitable for use in a liquid circulating system for circulating constant-temperature liquid for controlling temperature in a semiconductor fabricating apparatus, but it is not limited to such a use.

Figure 6:
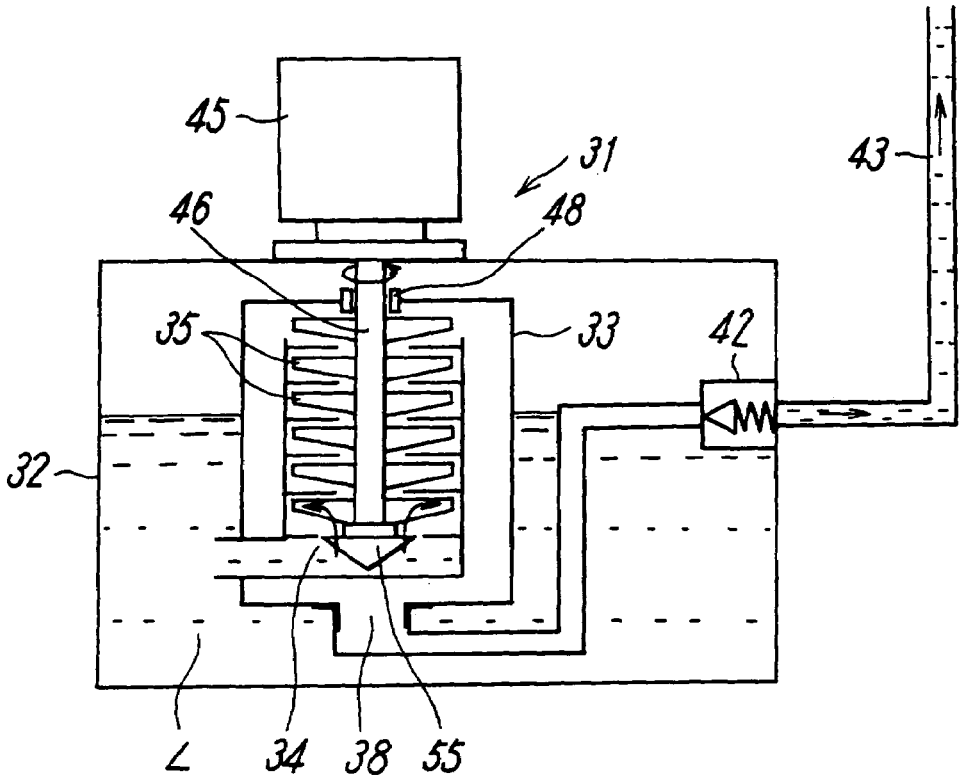
FIG. 6 (Prior Art)
FIG. 6 is a vertical sectional view showing a usage state of a known dipping type multi-stage pump.

Like the conventional example shown in FIG. 6, the above-described dipping type pump 1 is used in a state that a pump casing 3 is dipped in liquid L such as constant-temperature liquid received in a tank 2. The casing 3 is provided with a sucking port 4 which is positioned near its lower end and sucks liquid L in the tank 2, a pump chamber 6 which accommodates a plurality of impellers 5, a discharge flow path 7 which surrounds a periphery of the pump chamber, and a discharge port 8 which is positioned at a lower end portion of the casing 3 and through which liquid passing through the discharge flow path 7 from the pump chamber 6 is fed out.

The discharge port 8 is led to a side face of the tank 2 by a pipe 11 to be connected to an external piping system 13 via a check valve 12. Such a constitution can be employed that a discharge pipe (not shown) is opened at a lower portion of the tank 2 so that liquid is fed out to the external piping system from the discharge pipe.

Incidentally, the check valve 12 positioned at the secondary side of the pump is used, as needed, in order to prevent circulating liquid existing in the external piping system 13 from flowing backward to the side of the tank 2 at a time of stop of the pump.

Further, the dipping type pump 1 is constituted as a multi-stage pump by mounting, inside the pump chamber 6, the impellers 5 to a rotary shaft 16 extending from a motor 15 positioned outside the tank 2 into the casing 3 in a multi-stage manner.

Accordingly, in a circulating system provided with the dipping type pump shown in FIG. 1, by rotation of the impellers 5 according to the rotational driving of the motor 15, liquid is sucked from the sucking port 4 at the lower portion of the casing 3 and is pressurized to be discharged from the discharge port 8 positioned at the upper portion of the pump chamber 6 via the discharge flow path 7 around the pump chamber 6 and fed out to the external piping system 13 via piping 11 and the check valve 12. The fed-out liquid is returned back to the tank 2 from the external piping system 13 by a circulating pipe (not shown).

In the above-described dipping type pump, the rotary shaft 16 of the motor 15 penetrates the casing 3, but a seal 18 is provided at a penetrated portion of the casing 3 so that secure sealing for preventing leakage of liquid is performed, thereby improving a pump performance. As for the seal 18, it is unnecessary to use a seal member which has been specially designed for improving its sealing performance. The seal 18 may be one which makes sealing between the rotary shaft and a portion or a member receiving the rotary shaft securely to a certain extent and it may be a known sealing member.

However, when such sealing has been made, as described above, air or the like staying in the casing 3 can not be discharged, which may result in racing of the impellers 5 at a time of actuation of the pump. In order to solve this problem, a check valve 25 for air purge which allows outflow of gas from the interior of the casing 3 but prevents outflow of liquid is provided at an upper position inside the casing 3. The constitution and operation of the check valve 25 will be explained with reference to FIG. 3 to FIG. 5.

Figure 2:
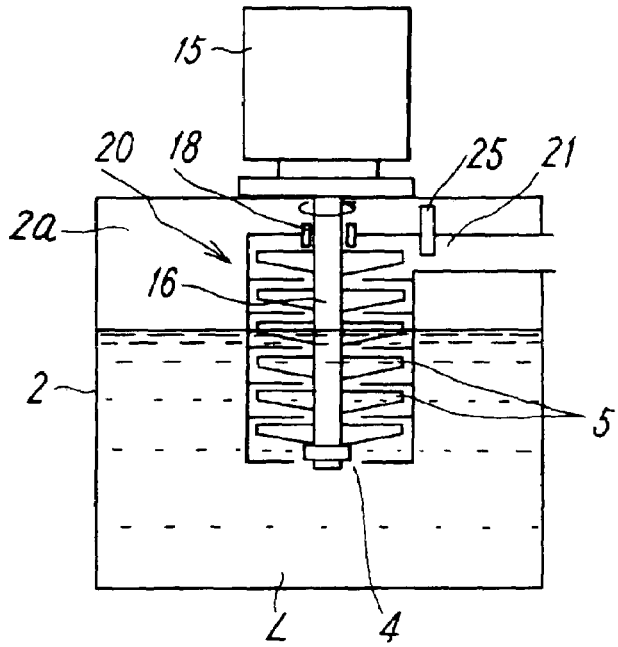
FIG. 2 is a vertical sectional view of another embodiment of the invention.

FIG. 2 shows another embodiment of a dipping type pump according to the present invention. In this embodiment, such a constitution is employed that liquid is discharged directly from a discharge port 21 provided at an upper portion of a casing 20 to an external piping system without providing discharge flow path 7 provided on the periphery of the casing 3 in the embodiment shown in FIG. 1. In this embodiment, a check valve 25 similar to that in the embodiment shown in FIG. 1 is also provided at an upper position inside the casing 20.

Incidentally, since the other constitution and operation in this embodiment are not difficult from those in the embodiment shown in FIG. 1, same reference numerals are attached to same main portions in this embodiment and explanation thereof will be omitted.

The dipping type pumps with the above constitutions shown in FIG. 1 and FIG. 2 are used in state that the pump casings 3, 20 have been dipped in the liquid L in the tank 2. At this time, since air, gas or the like is automatically discharged through the check valve 25 for air purge provided in the casing, the interior of the casing is always maintained in such a state that the liquid L has been filled up to the liquid level in the tank 2. Therefore, actuation of the pump is conducted remarkably smoothly and the discharge pressure of the pump can reach a sufficient discharge pressure just after actuation so that an excellent discharge performance at a time of actuation can be obtained.

Further, since the above-described check valve 25 allows outflow of gas inside the casing, it is possible to give the maximum sealing performance which can cut off both liquid and gas approximately completely to the seal 18 positioned at the portion of the casing which the rotary shaft penetrates. In addition, since the check valve 25 prevents outflow of liquid, liquid is prevented from leaking from the casing 3, 20 at a time of ordinary pump operation, so that a pump efficiency can be improved.

Figure 3:
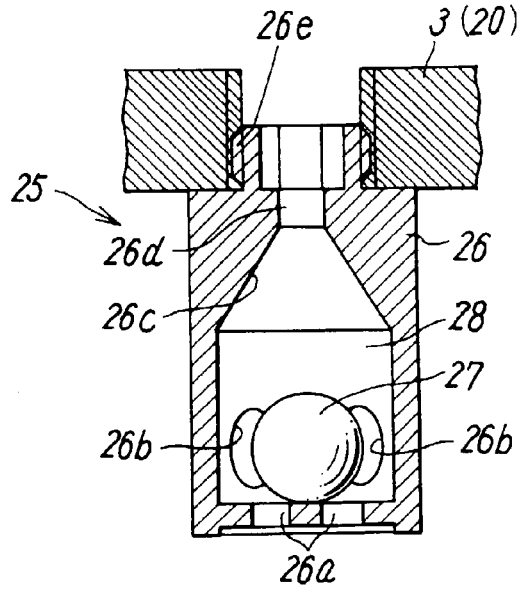
FIG. 3 is an enlarged vertical sectional view of a check valve for air purge used in the dipping type pump of the invention.
Figure 4:
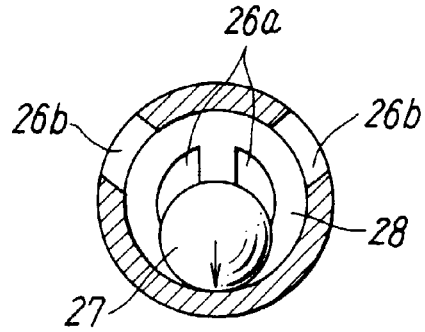
FIG. 4 is a cross-sectional view of the check valve.
Figure 5:
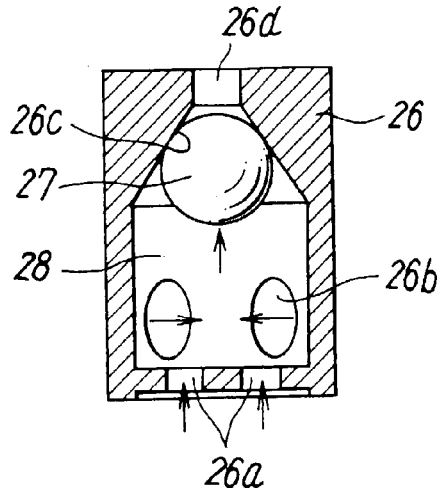
FIG. 5 is a vertical sectional view of an operation state of the check valve.

In the embodiments shown in FIG. 1 and FIG. 2, the check valves 25 for air purge provided the above-described casings 3, 20 each comprise a cylindrical valve housing 26, a cylindrical valve chamber 28 formed in the valve housing 26 and one spherical valve body 27 accommodated in the valve chamber 28 movably, as shown in FIG. 3 to FIG. 5, and they are mounted to the casings 3, 20 in a state that their cylindrical axial lines have been oriented vertically.

The above-described housing 26 comprises a plurality of fluid inflow holes 26*a* opened on a lower face of the valve chamber 28, and a plurality of fluid inflow holes 26*b* opened on a side face of the valve chamber 28. The plurality of inflow holes 26*b* of these holes on the side face of the valve chamber are provided at positions near to the lower end portion of the valve chamber 28 along the circumferential direction of the valve chamber 28, as apparently shown in FIG. 4. However, these holes are not provided at equal intervals over the entire periphery of the valve chamber 28 and all the inflow holes 26*b* are concentrically provided on only a semi-circle of the peripheral face of the valve chamber. Thereby, when gas or liquid flows in the valve chamber 28 from these inflow holes 26*b*, directionality is given to the flow of the gas or liquid.

Further, a relief port 26*d* connecting the valve chamber 28 and a gas phase portion 2*a* of the tank 2 is provided at an upper portion of the valve housing 26, and a conical relief valve seat 26*c* whose diameter gradually decreases toward the relief port 26*d* side is formed between the upper end portion of the valve chamber 28 and the relief port 26*d*. At least the relief valve seat 26*c* portion in the valve housing 26 is made of hard material to such an extent that a deformation such as compression or the like does not occur in the portion when the valve body 27 abuts against the portion, for example metal, ceramic or the like. Thereby, the valve body 27 is prevented from remaining in a state that it has been adhered to the relief valve seat 26*c* and the portion is prevented from be worn away.

Furthermore, the valve body 27 is made of hard material with a specific gravity larger than that of the liquid L which is not corroded by the liquid, such as, for example, stainless steel, and it can be constituted so as to develop a check function to gas and liquid by selecting the size, the weight of the material or the like properly so as to fit the liquid. That is, such a constitution is employed that, in case that gas in the casing 3, 20 flows in the valve chamber 28 from the inflow holes 26*a*, 26*b* on the lower face and side face of the valve housing 26 to flow out of the relief port 26*d*, the valve body 27 does not float up due to the flow of the gas, and therefore the relief valve seat 26*c* is not closed, but when liquid L in the casing flows from the relief port 26*d* through a similar path, the valve body 27 is pushed up by the flow of the liquid to close the valve seat 26*c*.

As a method for mounting the check valve 25 to the pump casing 3, 20, a method for screwing a screw portion 26*e* provided at an upper end of the valve housing 26 into a hole of the casing 3, 20 is shown in FIG. 3, but the present invention is not limited to such a mounting method and the check valve can be mounted to a hole of the casing 3, 20 by arbitrary means.

As shown in FIG. 4, since the check valve 25 having the above-described constitution is concentratively provided on a semi-circle of the periphery face of the valve housing 26 with the plurality of inflow holes 26*b*, when air flows in the valve chamber 28 from these inflow holes 26*b*, the spherical valve body 27 is moved to the side opposite to the inflow holes 26*b* by the flow of the air (refer to FIG. 4). For this reason, since the flow path from the inflow holes 26*a*, 26*b* to the outflow port 26*d* is expanded so that a large air flow path can be secured, air in the casing is rapidly discharged. The spherical valve body 27 has such a weight that it does not float up due to this air flow.

After the air has flowed out, liquid L pressurized by the impellers 5 flows into the valve housing 26. Since the valve body 27 is flowed in a pushing manner to be brought in pressure-contact with the valve seat 26*c* according to the flow of the liquid, as shown in FIG. 5, the flow path from the inflow holes 26*a*, 26*b* to the outflow port 26*d* is closed.

Incidentally, it is not said that there is not any possibility that liquid leaks slightly at a stage that the valve body 27 closes the valve seat 26*c*, but liquid leaked out is directly returned back to the tank 2, since the dipping type pump is originally used in a state that it has been dipped in liquid.

Thus, after air has been exhausted when the air exists in the casing, or simultaneously with pump operation when the air does not exist therein, the valve body of the check valve 25 automatically closes the valve seat 26*c*. Since the closed state is maintained during the pump operation so that leakage of the liquid is prevented, the pump efficiency is improved.

Further, since the check valve 25 is constituted with a valve housing 26 having a relatively easily workable shape and one spherical valve body 27 fitted movably in the interior of the valve housing, it has a simple structure and is small-sized and inexpensive, and it is easy to mount the valve housing to the casing so that the check valve can easily be incorporated into even a limited space such as the interior of the casing of the pump. Furthermore, the check valve 25 can easily be mounted to an existing dipping type pump.

As described in detail, according to the dipping type pump of the present invention, outflow of liquid from the casing due to an air vent structure is suppressed, and air or the like staying in the casing can automatically discharged by simple means, while improving a pump efficiency, so that not only the pump efficiency but also the discharge performance at a time of actuation of the dipping type pump can be improved.

The invention claimed is:

1. A dipping type pump where gas is discharged at a time of actuation, which is constituted such that a rotary shaft is provided inside a pump casing having a portion dipped in liquid, a plurality of impellers are mounted to the rotary shaft, and liquid is sucked from a sucking port at a lower portion of the pump casing and discharged from a discharging port by rotating and driving the rotary shaft by a motor, wherein a check valve for allowing outflow of gas from the casing but preventing outflow of liquid from the casing is provided at an upper position of the pump casing, wherein the check valve comprises a valve chamber provided with a relief valve seat communicating with a relief port, and only one spherical valve body movably accommodated in the valve chamber, wherein the relief valve seat is made of such hard material as metal or ceramic and is provided at a position of an upper end portion of the valve chamber, and the valve body is made of hard material having a specific gravity larger than that of the liquid and is accommodated in the valve chamber movably in a vertical direction, and the valve body opens the relief valve seat in ordinary operation and is constituted such that the valve body is not pushed and moved toward a position closing the relief valve seat by gas flowing from the casing into the valve chamber but is pushed and moved toward the position closing the relief valve seat by liquid flowing into the valve chamber.

2. A dipping type pump where gas is discharged at a time of actuation, comprising:

a pump casing whose portion is dipped in liquid in a tank;

a rotary shaft which penetrates an upper end wall of the casing and extends to an interior of the casing, and whose upper end is connected to a motor;

a plurality of impellers which are mounted to the rotary shaft;

a sealing portion which performs sealing between the upper end wall of the casing and the rotary shaft;

a sucking port and a discharging port of liquid formed in the casing; and a check valve which is provided at an upper portion of the casing such that the interior of the casing and a gas phase portion of the tank communicate with each other, and which allows outflow of gas from the interior of the casing but prevents outflow of liquid, wherein the check valve comprises a valve chamber formed in a valve housing, at least one fluid inflow hole formed at a lower portion position of the valve chamber, a relief port formed at an upper portion of the valve chamber, a relief valve seat formed between the valve chamber and the relief port, and only one spherical valve body which is accommodated in the valve chamber movably in a vertical direction and opens/closes the relief valve seat according to vertical movement of the valve body, and the specific gravity of the valve body is larger than the specific gravity of the liquid, and wherein the valve body opens the relief valve seat in ordinary operation and does not close the relief valve seat by action of gas flow, but closes the relief valve seat when acted upon by liquid flow.

3. A dipping type pump according to claim 2, wherein the relief valve seat is formed in a conical shape and made of hard material, and the valve body is made of hard material.

4. A dipping type pump according to claim 2, where the sealing portion has a sealing performance to such an extent that outflow of gas and liquid from the interior of the casing can be prevented substantially completely.

5. A dipping type pump where gas is discharged at a time of actuation, comprising:

a pump casing whose portion is dipped in liquid in a tank;

a rotary shaft which penetrates an upper end wall of the casing and extends to an interior of the casing, and whose upper end is connected to a motor;

a plurality of impellers which are mounted to the rotary shaft;

a sealing portion which performs sealing between the upper end wall of the casing and the rotary shaft;

a sucking port and a discharging port of liquid formed in the casing; and a check valve which is provided at an upper portion of the casing such that the interior of the casing and a gas phase portion of the tank communicate with each other, and which allows outflow of gas from the interior of the casing but prevents outflow of liquid, wherein the check valve comprises a valve chamber formed in a valve housing, at least one fluid inflow hole formed at a lower portion position of the valve chamber, a relief port formed at an upper portion of the valve chamber, a relief valve seat formed between the valve chamber and the relief port, and one spherical valve body which is accommodated in the valve chamber movably in a vertical direction and opens/closes the relief valve seat according to vertical movement of the valve body, and the specific gravity of the valve body is larger than the specific gravity of the liquid, and wherein the valve chamber is formed in a vertically cylindrical shape, and a plurality of the fluid inflow holes are formed for each of a bottom face and a side face of the valve chamber, the fluid inflow holes on the side face of the valve chamber are concentrically formed on a semi-circle side of the peripheral face of the valve chamber.

6. A dipping type pump according to claim 5, wherein the relief valve seat is formed in a conical shape and made of hard material, and the valve body is made of hard material.

* * * * *